US010236619B1

(12) United States Patent
Sato

(10) Patent No.: US 10,236,619 B1
(45) Date of Patent: Mar. 19, 2019

(54) CONNECTOR ASSEMBLY

(71) Applicant: JAPAN AVIATION ELECTRONICS INDUSTRY, LIMITED, Tokyo (JP)

(72) Inventor: Yukiko Sato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/148,516

(22) Filed: Oct. 1, 2018

(30) Foreign Application Priority Data

Nov. 28, 2017 (JP) ..... 2017-227443

(51) Int. Cl.

| | |
|---|---|
| ***H01R 9/03*** | (2006.01) |
| ***H01R 13/518*** | (2006.01) |
| ***H01R 13/6581*** | (2011.01) |
| ***H01R 13/504*** | (2006.01) |
| *H01R 12/72* | (2011.01) |
| *H01R 24/60* | (2011.01) |
| *H01R 107/00* | (2006.01) |

(52) U.S. Cl.
CPC ..... *H01R 13/518* (2013.01); *H01R 13/504* (2013.01); *H01R 13/6581* (2013.01); *H01R 12/722* (2013.01); *H01R 24/60* (2013.01); *H01R 2107/00* (2013.01)

(58) Field of Classification Search
CPC ..... H01R 13/518; H01R 13/504; H01R 13/6581; H01R 12/722; H01R 24/60; H01R 2107/00
USPC ..... 439/540.1, 607.01
See application file for complete search history.

(56) References Cited

U.S. PATENT DOCUMENTS

| | | | | |
|---|---|---|---|---|
| 8,968,031 | B2 | 3/2015 | Simmel et al. | |
| 9,887,472 | B2 * | 2/2018 | Park | H01R 12/7076 |
| 10,027,063 | B2 * | 7/2018 | Peng | H01R 12/594 |

FOREIGN PATENT DOCUMENTS

| | | | |
|---|---|---|---|
| CN | 204179317 | U | 2/2015 |
| CN | 104733956 | A | 6/2015 |
| JP | 2000-036339 | A | 2/2000 |
| JP | 2017-168423 | A | 9/2017 |

* cited by examiner

*Primary Examiner* — Khiem M Nguyen
(74) *Attorney, Agent, or Firm* — Collard & Roe, P.C.

(57) ABSTRACT

A connector assembly comprises two connectors and a coupling member. The coupling member couples the two connectors which are apart from each other in a lateral direction. The coupling member has a top plate and two positioning sets which correspond to the two connectors, respectively. Each of the positioning sets includes a positioning portion and a resilient portion. The top plate has a single and continuous flat-plate shape and is located above the two connectors in an upper-lower direction perpendicular to the lateral direction. Each of the positioning portions extends downward from the top plate and is located outward of the corresponding connector in the lateral direction. Each of the resilient portions is fixed to the top plate, is located inward of the corresponding connector in the lateral direction and presses the corresponding connector against the corresponding positioning portion.

13 Claims, 8 Drawing Sheets

CONNECTOR ASSEMBLY

CROSS REFERENCE TO RELATED APPLICATIONS

This application is based on and claims priority under 35 U.S.C. § 119 to Japanese Patent Application No. JP2017-227443 filed Nov. 28, 2017, the content of which is incorporated herein in its entirety by reference.

BACKGROUND OF THE INVENTION

This invention relates to a connector assembly comprising two connectors coupled to each other by a coupling member.

For example, this type of connector assembly is disclosed in JP2017-168423A (Patent Document 1), the content of which is incorporated herein by reference.

Referring to FIG. 14, Patent Document 1 discloses a receptacle docking connector (connector assembly) 90 which comprises two receptacle connectors (connectors) 92, two additional receptacle connectors (connectors) 94 and a guide shell (coupling member) 96 made of a metal plate. The coupling member 96 is bent at a plurality of portions to be formed with two receiving portions 962 and two guide receiving portions (receiving portions) 964. Upon installation of the connector assembly 90 into a device, each of the connectors 92 is first mounted on a predetermined part of a board 98 while the connectors 94 are arranged inside the receiving portions 964 of the coupling member 96, respectively. Then, the coupling member 96 is mounted on the predetermined part of the board 98 together with the connectors 94.

It is required that, when two connectors which are apart from each other are coupled to each other by a coupling member, variation of a distance between the two connectors be reduced.

SUMMARY OF THE INVENTION

It is therefore an object of the present invention to provide a connector assembly comprising a coupling member having a new structure for reducing variation of a distance between two connectors.

An aspect of the present invention provides a connector assembly comprising two connectors and a coupling member. The coupling member couples the two connectors which are apart from each other in a lateral direction. The coupling member has a top plate and two positioning sets which correspond to the two connectors, respectively. Each of the positioning sets includes a positioning portion and a resilient portion. The top plate has a single and continuous flat-plate shape and is located above the two connectors in an upper-lower direction perpendicular to the lateral direction. Each of the positioning portions extends downward from the top plate and is located outward of a corresponding one of the connectors in the lateral direction. Each of the resilient portions is fixed to the top plate, is located inward of the corresponding one of the connectors in the lateral direction and presses the corresponding one of the connectors against a corresponding one of the positioning portions.

According to an aspect of the present invention, each of the connectors is pressed against the corresponding positioning portion by the corresponding resilient portion to be positioned in the lateral direction. Each of the positioning portions is an extending portion that extends from the top plate, and the extending portion can be formed to be accurately positioned relative to the top plate. Moreover, since the top plate has a single and continuous flat-plate shape, a distance between the two positioning portions is almost unchanged. As described above, the coupling member according to an aspect of the present invention has a new structure for reducing variation of the distance between the two connectors.

An appreciation of the objectives of the present invention and a more complete understanding of its structure may be had by studying the following description of the preferred embodiment and by referring to the accompanying drawings.

Figure 1:
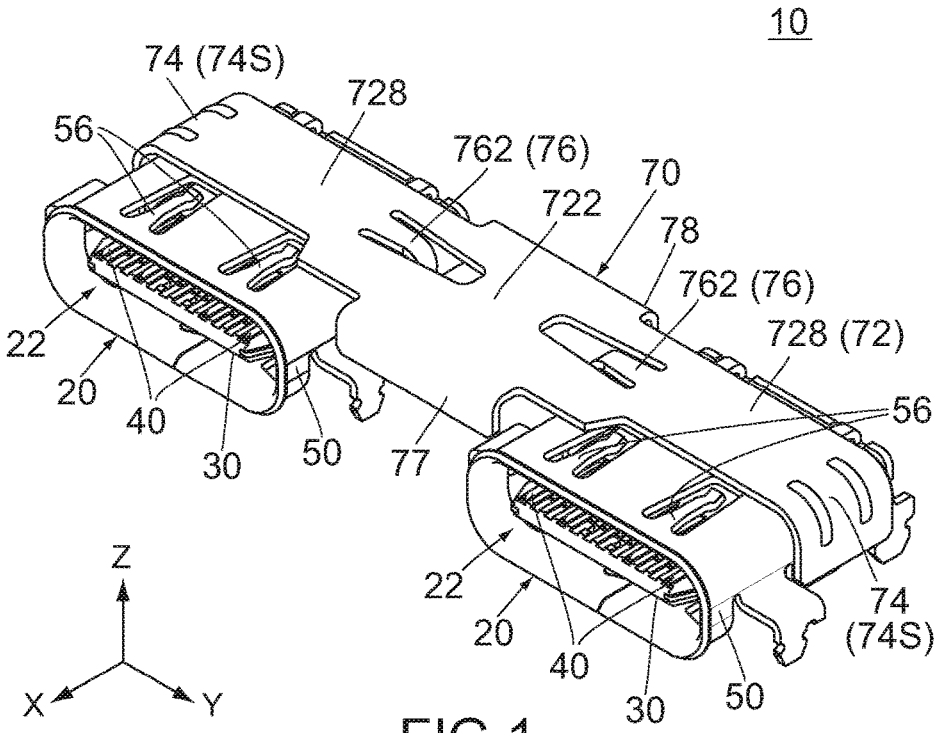
FIG. 1 is a perspective view showing a connector assembly according to an embodiment of the present invention, wherein two connectors of the connector assembly are temporarily held by a coupling member.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 4, a connector assembly 10 according to an embodiment of the present invention comprises two connectors 20 separated from each other and a coupling member 70 made of metal. The coupling member 70 couples the two connectors 20 in a lateral direction (Y-direction) so that the two connectors 20 are apart from each other in the Y-direction. In other words, the two connectors 20 that are coupled to each other are apart from each other in the Y-direction. The connectors 20 are located at opposite sides of the connector assembly 10 in the Y-direction, respectively.

In the present embodiment, one of the connectors 20 is formed of members same as those of a remaining one of the connectors 20, and the connectors 20 have shapes and sizes same as each other. In other words, the connectors 20 are same devices having structures same as each other. However, the present invention is not limited thereto, but the connectors 20 may have structures different from each other.

Figure 8:
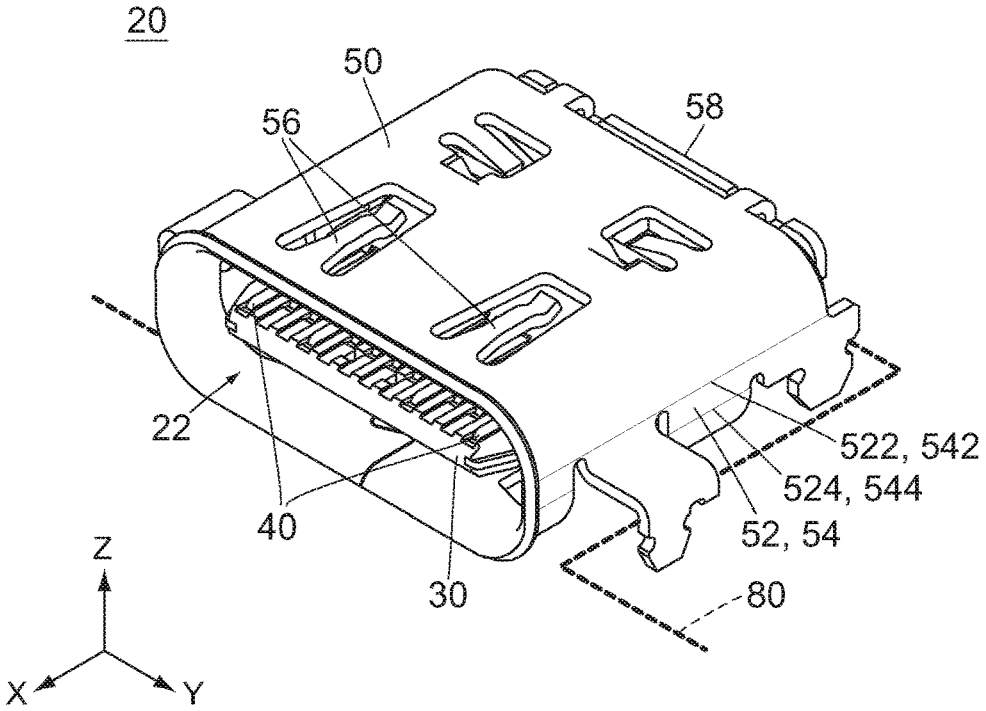
FIG. 8 is a perspective view showing the connector of the connector assembly of FIG. 1, wherein an outline of a circuit board, to which the connector is attached, is illustrated in dotted line.

Referring to FIG. 8, the connector 20 of the present embodiment is a receptacle of universal serial bus (USB) 3.1 TYPE-C. Moreover, the connector 20 is a so-called drop-in connector which is attached to a circuit board 80 so as to be partially received in a cut of the circuit board 80 when used. However, the present invention is not limited thereto. For example, the connector 20 is not limited to a USB connector. Moreover, the connector 20 may be an on-board connector which is mounted on the circuit board 80 when used.

Figure 3:
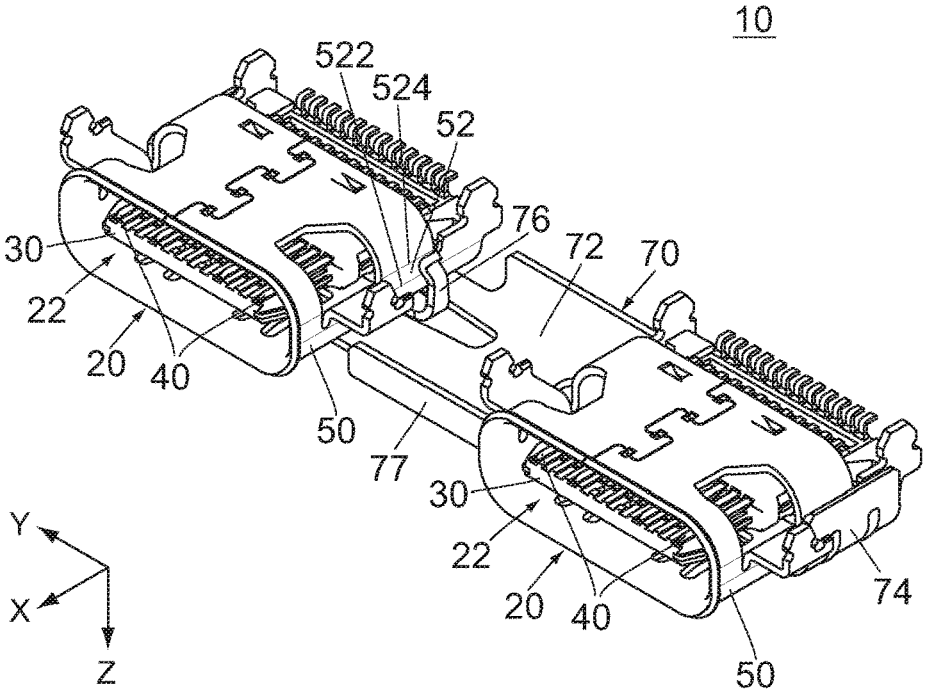
FIG. 3 is still another perspective view showing the connector assembly of FIG. 1.

Each of the connectors 20 comprises a holding member 30 made of insulator such as resin, a plurality of terminals 40 each made of conductor and a shell 50 made of conductor. Each of the connectors 20 has an almost mirror-symmetrical shape with respect to the XZ-plane. Referring to FIGS. 1 and 3, the terminals 40 are separated in two rows. The terminals 40 of each row are arranged in a pitch direction (Y-direction) and held by the holding member 30. Referring to FIG. 8, the shell 50 is formed of a single metal plate which is bent about an axis in parallel to the X-direction. The shell 50 covers the holding member 30 mainly in the YZ-plane. Thus, the shell 50 covers, at least in part, the holding member 30.

The connector 20 of the present embodiment has the aforementioned structure. However, the present invention is not limited thereto, but the structure of the connector 20 can be variously modified. For example, the connector 20 does not need to comprise the shell 50.

Each of the connectors 20 has a fit portion 22 into which a plug, namely a mating connector (not shown), is to be fit. As shown in FIGS. 1 and 3, in the present embodiment, the two connectors 20 of the connector assembly 10 are arranged to face the same direction. In detail, each of the fit portions 22 is located at a front end portion (positive X-side end portion) of the connector 20 in a front-rear direction (X-direction) and opens forward, or in the positive X-direction. However, the present invention is not limited thereto, but the two connectors 20 may be arranged to face opposite directions to each other.

Figure 6:
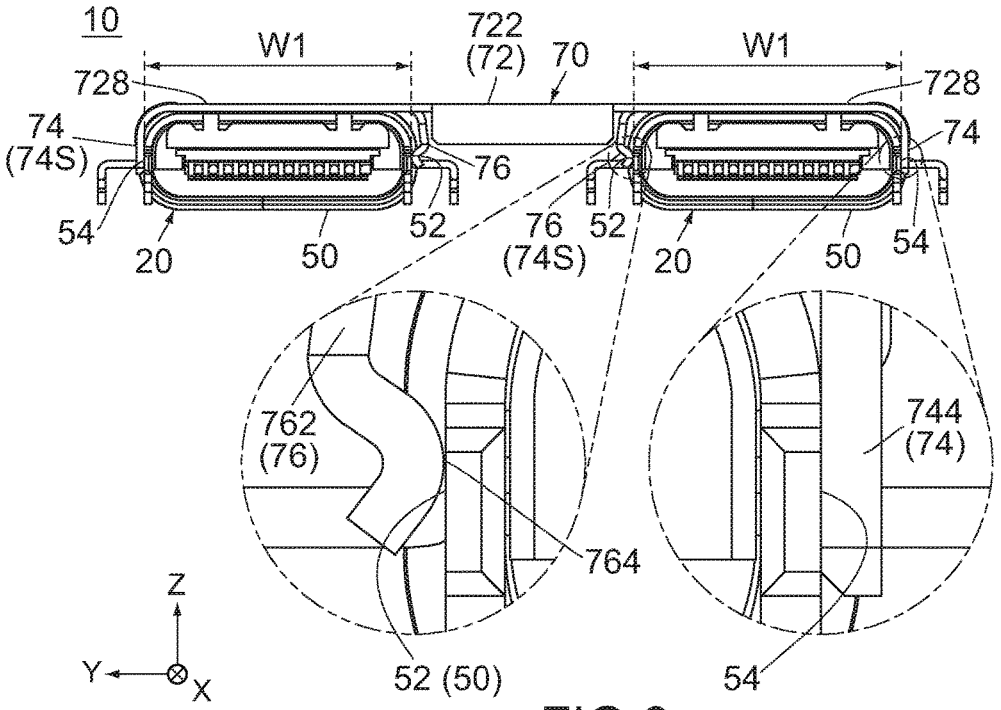
FIG. 6 is a rear view showing the connector assembly of FIG. 1, wherein a part of the connector assembly enclosed by chain dotted line and another part of the connector assembly enclosed by two-dot chain line are enlarged to be illustrated.

Referring to FIGS. 6 and 8, in the present embodiment, each of the shells 50 has an inside flat portion 52 and an outside flat portion 54. The inside flat portion 52 and the outside flat portion 54 of one of the connectors 20 are portions same as the outside flat portion 54 and the inside flat portion 52 of a remaining one of the connectors 20, respectively.

Figure 4:
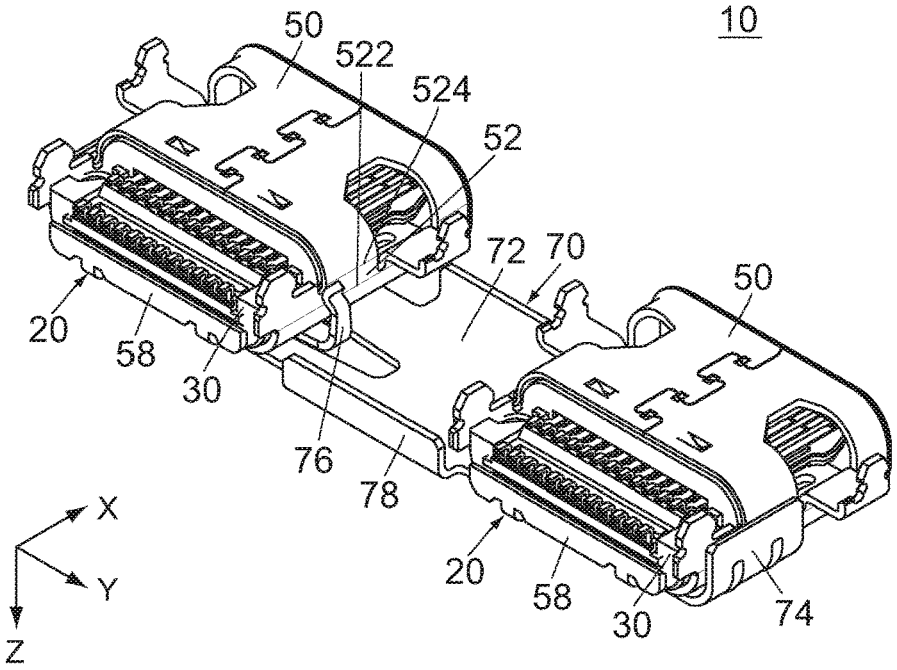
FIG. 4 is yet another perspective view showing the connector assembly of FIG. 1.

Referring to FIGS. 3, 4 and 6, the two inside flat portions 52 are located at the middle of the connector assembly 10 in the Y-direction and face each other in the Y-direction. In detail, each of the shells 50 has an inside surface which is located near the middle of the connector assembly 10 in the Y-direction. The inside flat portion 52 of each of the connectors 20 is a part of this inside surface of the shell 50. Referring to FIG. 6, the two outside flat portions 54 are located at opposite sides of the connector assembly 10 in the Y-direction, respectively. In detail, each of the shells 50 has an outside surface which is far apart from the middle of the connector assembly 10 in the Y-direction. The outside flat portion 54 of each of the connectors 20 is a part of this outside surface of the shell 50.

Referring to FIG. 8 together with FIG. 6, each of the inside flat portions 52 is a part that is vertically located between an imaginary boundary 522 and another imaginary boundary 524 of the inside surface of the shell 50 in an upper-lower direction (Z-direction). Similarly, each of the outside flat portions 54 is a part that is vertically located between an imaginary boundary 542 and another imaginary boundary 544 of the outside surface of the shell 50. Each of the inside flat portions 52 and the outside flat portions 54 of the present embodiment is a plane perpendicular to the Y-direction. However, the present invention is not limited thereto, but each of the inside flat portions 52 and the outside flat portions 54 may be oblique to the Y-direction to some extent. Thus, each of the inside flat portions 52 and the outside flat portions 54 may intersect with the Y-direction.

Figure 2:
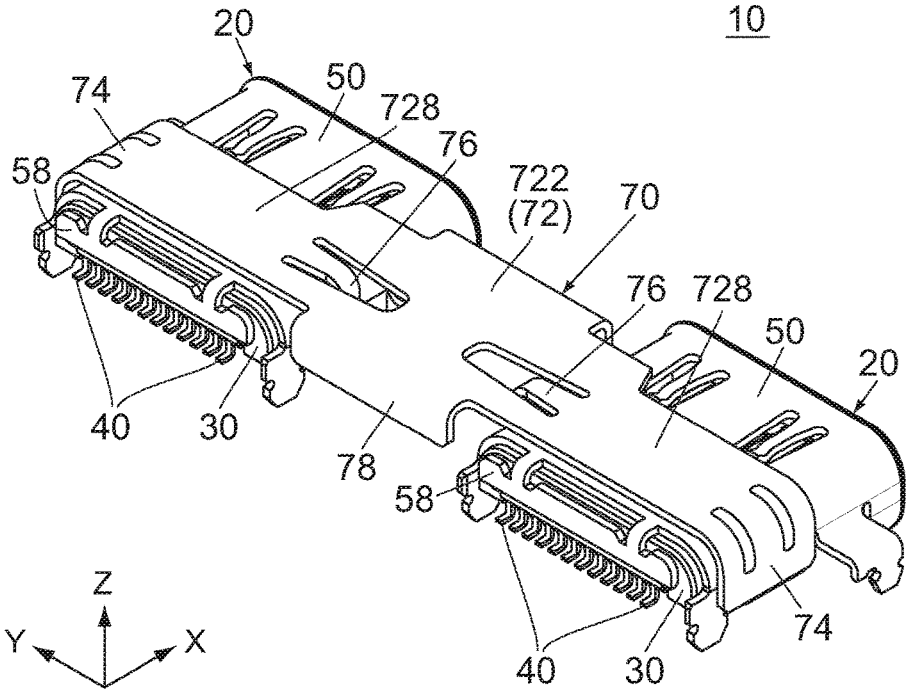
FIG. 2 is another perspective view showing the connector assembly of FIG. 1.

As shown in FIGS. 2, 4 and 8, each of the shells 50 of the present embodiment has a rear side portion 58. The rear side portion 58 is located at a rear end (negative X-side end) of the connector 20 and partially covers the holding member 30 from behind. According to the present embodiment, a lower part (negative Z-side part) of the connector 20 is received in the cut of the circuit board 80 when the connector 20 is used. According to this arrangement, the rear side portion 58 covers only an upper part (positive Z-side part) of the holding member 30. However, the present invention is not limited thereto, but the rear side portion 58 may entirely cover the holding member 30 from behind in accordance with the structure of the connector 20. Moreover, the rear side portion 58 may be provided as necessary.

As shown in FIGS. 1 and 8, each of the shells 50 of the present embodiment has two spring portions 56. Under a mated state where the connector 20 is mated with the mating connector (not shown), each of the spring portions 56 is brought into contact with a mating shell (not shown) of the mating connector. However, the present invention is not limited thereto, but the spring portions 56 may be provided as necessary.

Figure 9:
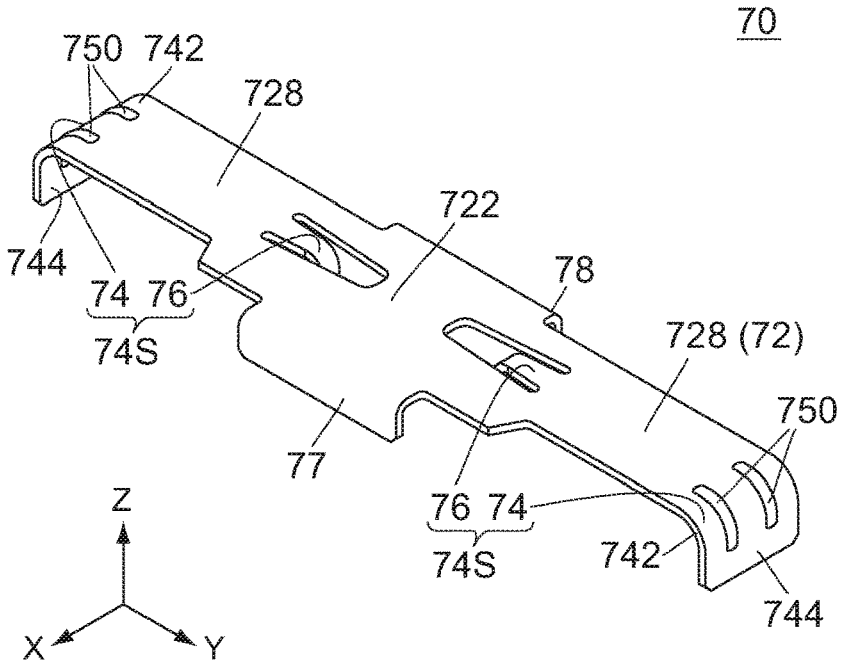
FIG. 9 is a perspective view showing the coupling member of the connector assembly of FIG. 1.

Referring to FIG. 9, the coupling member 70 of the present embodiment is a single metal plate with bends and has a mirror-symmetrical shape with respect to the XZ-plane. The coupling member 70 has a top plate 72, two positioning sets 74S, a front reinforcement portion (reinforcement portion) 77 and a rear reinforcement portion (reinforcement portion) 78. Each of the positioning sets 74S includes a positioning portion 74 and a resilient portion 76. However, the structure of the coupling member 70 is not limited to the aforementioned structure but can be variously modified as described later.

Figure 10:
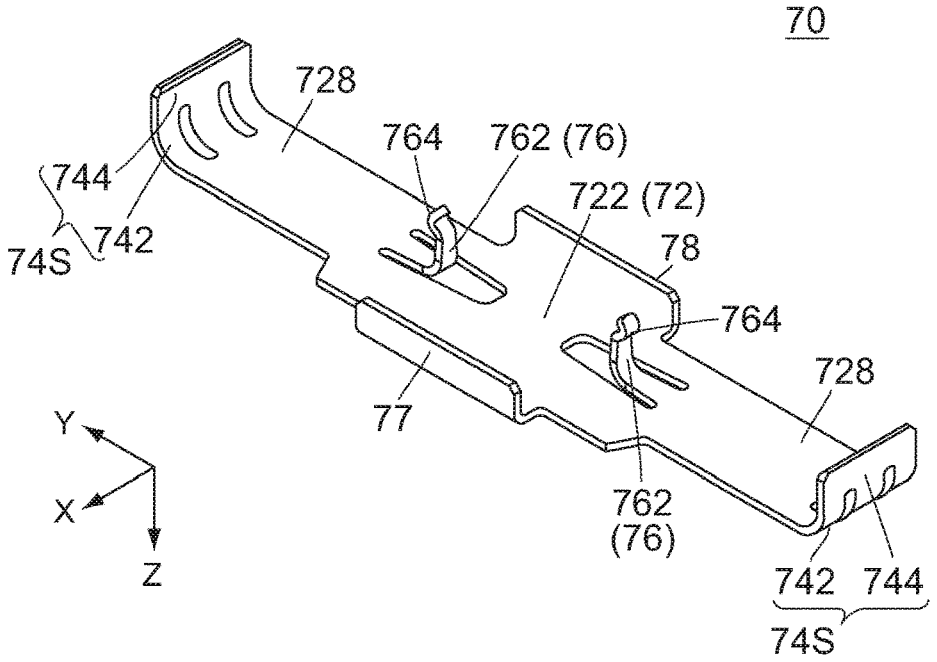
FIG. 10 is another perspective view showing the coupling member of FIG. 9.
Figure 11:
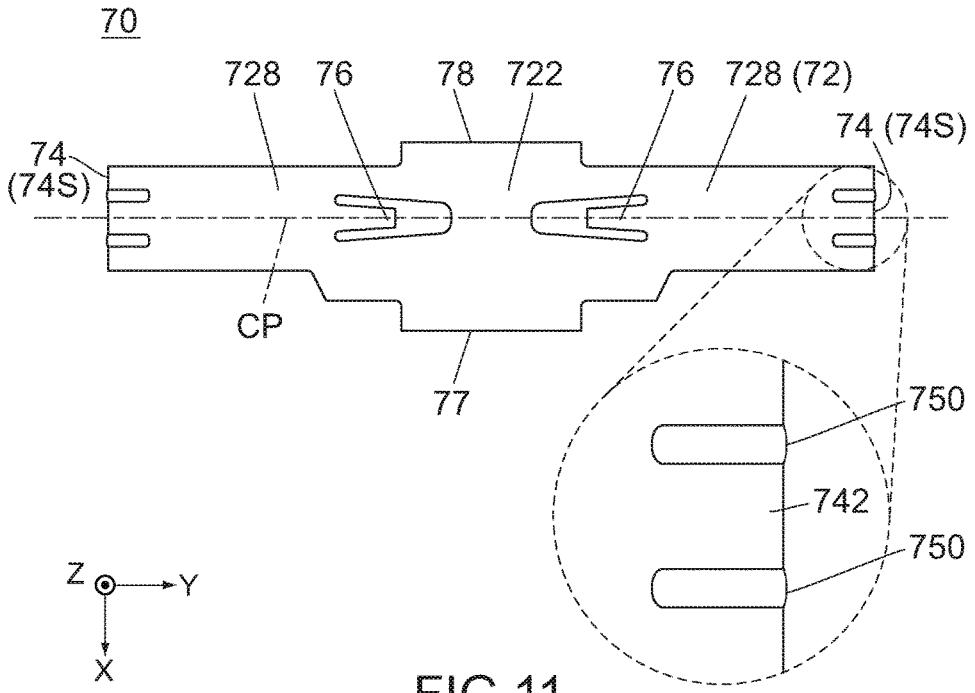
FIG. 11 is a top view showing the coupling member of FIG. 9, wherein a part of the coupling member enclosed by dotted line is enlarged to be illustrated.

Referring to FIGS. 9 to 13, the top plate 72 has a single and continuous flat-plate shape which extends along the XY-plane. Referring to FIGS. 9 and 11, the top plate 72 of the present embodiment extends long in the Y-direction to have a middle plate 722 and two end plates 728. The middle plate 722 is located at the middle of the top plate 72 in the Y-direction. The end plates 728 are located at opposite sides of the middle plate 722 in the Y-direction, respectively. In the present embodiment, no visible boundary such as a depression or a protrusion is provided between each of the end plates 728 and the middle plate 722. However, the present invention is not limited thereto, but a visible boundary may be provided between each of the end plates 728 and the middle plate 722.

Figure 12:
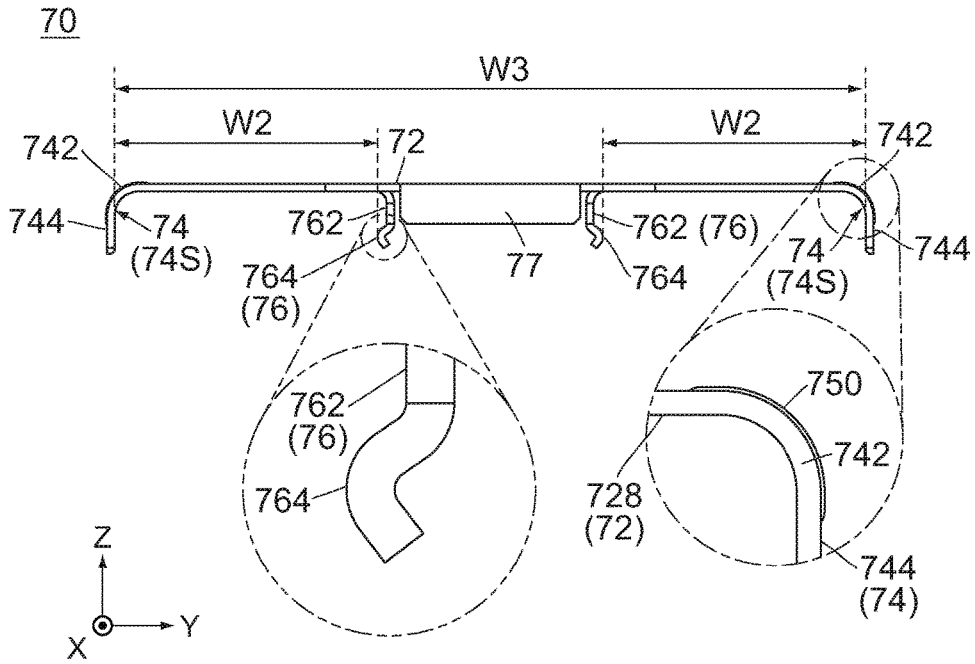
FIG. 12 is a front view showing the coupling member of FIG. 9, wherein a part of the coupling member enclosed by chain dotted line and another part of the coupling member enclosed by two-dot chain line are enlarged to be illustrated.

Referring to FIGS. 9, 10 and 12, the positioning portions 74 are located at opposite ends of the top plate 72 in the Y-direction, respectively. Each of the positioning portions 74 extends downward in the Z-direction, or extends in the negative Z-direction, from the top plate 72. Referring to FIG. 9, the positioning portions 74 are connected to the two end plates 728 of the top plate 72, respectively. Thus, the positioning portions 74 correspond to the end plates 728, respectively. In the present embodiment, no visible boundary such as a depression or a protrusion is provided between each of the positioning portions 74 and the corresponding end plate 728. However, the present invention is not limited thereto, but a visible boundary may be provided between each of the positioning portions 74 and the corresponding end plate 728.

Referring to FIGS. 9, 10 and 12, each of the positioning portions 74 has a connection portion 742 and a stopper 744. Each of the connection portions 742 extends downward from the corresponding end plate 728 to have an arc shape in the YZ-plane. In each of the positioning portions 74, the stopper 744 is located in the vicinity of a lower end (negative Z-side end) of the positioning portion 74 and extends downward from a lower end of the connection portion 742. For each of the positioning portions 74, the connection portion 742 connects the stopper 744 to the top plate 72.

In the present embodiment, each of the stoppers 744 has a flat-plate shape perpendicular to the Y-direction. Each of the stoppers 744 has an inside surface in the Y-direction, or a surface facing the opposite stopper 744, which is a plane perpendicular to the Y-direction. However, the present invention is not limited thereto, but each of the stoppers 744 may be oblique to the Y-direction to some extent. Thus, each of the stoppers 744 may have a flat-plate shape intersecting with the Y-direction. In other words, the inside surface of each of the stoppers 744 in the Y-direction may be a plane intersecting with the Y-direction.

Figure 13:
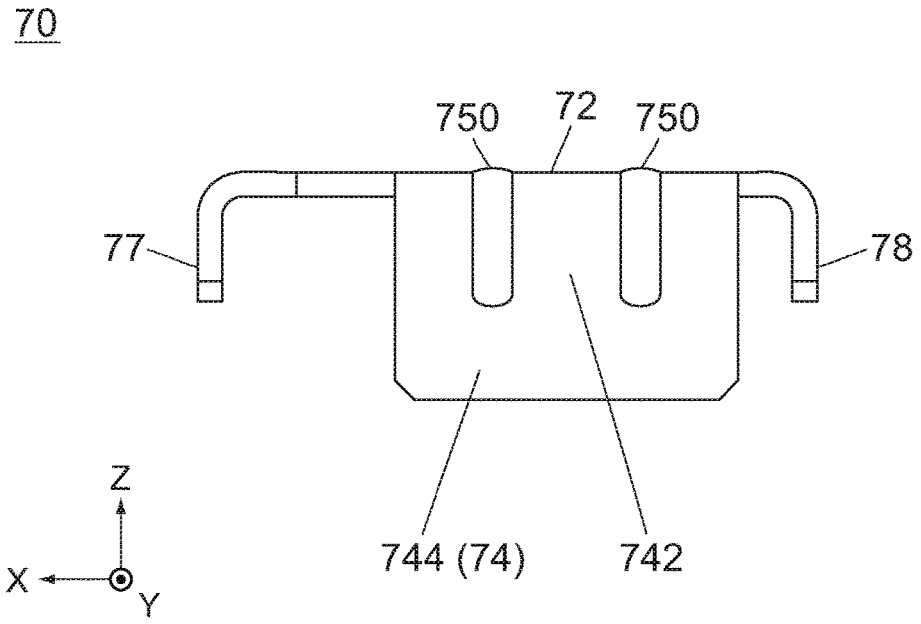
FIG. 13 is a side view showing the coupling member of FIG. 9.
Figure 14:
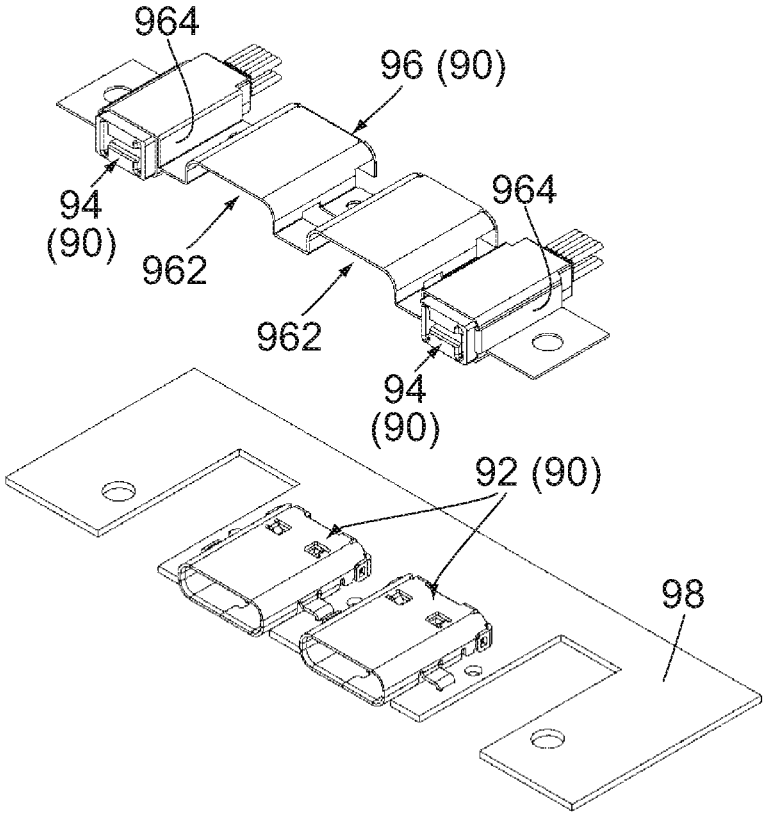
FIG.14 PRIOR ART
FIG. 14 is an exploded, perspective view showing a connector assembly of Patent Document 1.

Referring to FIG. 9, each of the connection portions 742 is formed with two ribs 750. Each of the ribs 750 extends from the vicinity of an inner end of the connection portion 742 in the Y-direction, or from the vicinity of a boundary between the connection portion 742 and the end plate 728, to the vicinity of a lower end of the connection portion 742. Each of the ribs 750 has an arc shape in the YZ-plane. Referring to FIGS. 11 to 13, each of the ribs 750 protrudes outward in a plane defined by the Y-direction and the Z-direction, or in the YZ-plane. According to the present embodiment, each of the connection portions 742 is reinforced by the two ribs 750 to be hardly bent. In other words, each of the stoppers 744 is hardly moved relative to the top plate 72 even when the stopper 744 receives some force. However, the present invention is not limited thereto. The ribs 750 may be provided as necessary. Moreover, the ribs 750 may be provided in necessary number.

Referring to FIGS. 9 to 11, each of the resilient portions 76 is formed of a part of the top plate 72 which is formed by partially cutting the top plate 72 followed by bending downward. Thus, each of the resilient portions 76 is fixed to the top plate 72. Referring to FIGS. 10 and 12, each of the resilient portions 76 has a support portion 762 and a pressing portion 764. Each of the support portions 762 is connected to the top plate 72 and extends downward from the top plate 72 in the Z-direction. In each of the resilient portions 76, the pressing portion 764 is located under the support portion 762 and has an arc shape which protrudes outward, or toward the corresponding stopper 744, in the Y-direction. Each of the support portions 762 is resiliently deformable. In each of the resilient portions 76, the pressing portion 764 is supported by the support portion 762 and is movable in the Y-direction in accordance with the resilient deformation of the support portion 762.

Referring to FIGS. 9 and 10, the reinforcement portion 77 extends downward in the Z-direction from a front end of the middle plate 722 of the top plate 72, and the reinforcement portion 78 extends downward in the Z-direction from a rear end of the middle plate 722 of the top plate 72. Each of the reinforcement portion 77 and the reinforcement portion 78 extends almost entirely over the middle plate 722 in the Y-direction. According to the present embodiment, the top plate 72 is reinforced by the reinforcement portion 77 and the reinforcement portion 78 so that the top plate 72 is hardly bent. The top plate 72, particularly the middle plate 722, is hardly bent even when some force is applied thereto. However, the present invention is not limited thereto, but each of the reinforcement portion 77 and the reinforcement portion 78 may be provided as necessary. For example, the coupling member 70 may have at least one reinforcement portion, or at least one of the reinforcement portion 77 and the reinforcement portion 78. The at least one reinforcement portion, or at least one of the reinforcement portion 77 and the reinforcement portion 78, may be formed on at least one of a front end and a rear end of the top plate 72 in the X-direction.

Referring to FIG. 1, the two end plates 728 of the top plate 72 of the coupling member 70 correspond to the connectors 20, respectively. In addition, referring to FIGS. 1 and 9, the two positioning sets 74S of the coupling member 70 correspond to the connectors 20, respectively. Each of the end plates 728 is arranged in the Y-direction together with the corresponding positioning portion 74 and the support portion 762 of the corresponding resilient portion 76. As described above, one of the connectors 20 corresponds to one of the end plates 728 and one of the positioning sets 74S, and a remaining one of the connectors 20 corresponds to a remaining one of the end plates 728 and a remaining one of the positioning sets 74S.

Referring to FIGS. 1 and 3, each of the connectors 20 is attached to the corresponding end plate 728 and the corresponding positioning set 74S from below so that the connector assembly 10 is formed. Referring to FIG. 6, the top plate 72 of the connector assembly 10 is located above the two connectors 20 in the Z-direction and extends along the XY-plane. Each of the end plates 728 is in contact with or close to an upper surface (positive Z-side surface) of the shell 50 of the corresponding connector 20. Each of the positioning portions 74 is located outward of the corresponding connector 20 in the Y-direction with respect to the middle of the connector assembly 10 in the Y-direction. Each of the resilient portions 76 is located inward of the corresponding connector 20 in the Y-direction with respect to the middle of the connector assembly 10 in the Y-direction.

Referring to FIG. 6, each of the connectors 20 has a dimension W1 that is a width dimension thereof in the Y-direction. The dimension W1 of the present embodiment is a width dimension between the inside flat portion 52 and the outside flat portion 54 of the connector 20 in the Y-direction. Referring to FIG. 12, each of the positioning sets 74S has a dimension W2 that is a distance dimension between the positioning portion 74 and the resilient portion 76 in the Y-direction. The dimension W2 of the present embodiment is a distance dimension between the inside surface of the stopper 744 of the positioning portion 74 and the outermost part of the pressing portion 764 of the resilient portion 76 in the Y-direction under a state where the connectors 20 (see FIG. 6) are not attached to the coupling member 70. The inside surface of the stopper 744 is a surface that faces the corresponding pressing portion 764 in the Y-direction. The outermost part of the pressing portion 764 is a part that is nearest to the corresponding stopper 744 in the Y-direction.

Referring to FIGS. 6 and 12, the dimension W2 is slightly smaller than the dimension W1. Therefore, in an attachment process in which each of the connectors 20 is attached to the coupling member 70, the connector 20 is guided by a lower end portion of the resilient portion 76 and is received between the positioning portion 74 and the resilient portion 76 while the support portion 762 is resiliently deformed. In detail, in the attachment process, the support portion 762 is resiliently deformed, so that the pressing portion 764 is moved inward in the Y-direction so as to be apart from the corresponding positioning portion 74 while pushing the corresponding connector 20 outward in the Y-direction, or toward the corresponding positioning portion 74. As a result, each of the resilient portions 76 of the connector assembly 10 presses the corresponding connector 20 against the corresponding positioning portion 74.

Referring to FIG. 6, as described above, according to the connector assembly 10, each of the connectors 20 is pressed against the corresponding positioning portion 74 by the corresponding resilient portion 76 to be temporarily held by the coupling member 70 and to be positioned in the Y-direction. Each of the positioning portions 74 is an extending portion that extends from the top plate 72, and such extending portion can be formed in a bending process to be accurately positioned relative to the top plate 72. Moreover, since the top plate 72 has a single and continuous flat-plate shape, a distance between the two positioning portions 74 of the top plate 72 in the Y-direction is almost unchanged.

In detail, referring to FIGS. 1 and 12, the coupling member 70 has a dimension W3 in the Y-direction that is a distance dimension between the inside surfaces of the two stoppers 744 in the Y-direction. The dimension W3 is substantially unchanged before and after the connectors 20 are attached to the coupling member 70. Therefore, the two connectors 20 of the connector assembly 10 can be positioned so as to be apart from each other by an accurate distance defined by the dimension W3. In detail, referring to FIGS. 6 and 12, the outside flat portions 54 of the two connectors 20 can be positioned so as to be apart from each other by the dimension W3. In addition, the inside flat portions 52 of the two connectors 20 can be positioned so as to be apart from each other by the distance defined by the dimensions W1 and W3. As described above, the coupling member 70 has a new structure for reducing variation of the distance between the two connectors 20.

Referring to FIG. 9, the coupling member 70 of the present embodiment is reinforced by the previously described various reinforcement portions, namely the reinforcement portion 77, the reinforcement portion 78 and a plurality of the ribs 750, so that the dimension W3 (see FIG. 12) can be more reliably kept. However, the present invention is not limited thereto, but each of the reinforcement portions may be provided in a preferable shape at a preferable part of the coupling member 70 as necessary.

Referring to FIGS. 9, 10 and 13, according to the present embodiment, for each of the positioning sets 74S, the positioning portion 74 entirely hides the resilient portion 76 so that the resilient portion 76 is invisible when the coupling member 70 is seen along the Y-direction. In other words, for each of the positioning sets 74S, an occupation area of the resilient portion 76 in the XZ-plane is included in another occupation area of the positioning portion 74 in the XZ-plane. Referring to FIG. 6, according to this arrangement, each of the resilient portions 76 can securely press the corresponding connector 20 against the corresponding positioning portion 74. However, the present invention is not limited thereto. For example, for each of the positioning sets 74S, the positioning portion 74 may cover, at least in part, the resilient portion 76 when the coupling member 70 is seen along the Y-direction.

Referring to FIG. 11, according to the present embodiment, the middle position of the positioning portion 74 of each of the positioning sets 74S in the X-direction is equal to the middle position CP of the end plate 728 in the X-direction, and the middle position of the resilient portion 76 of each of the positioning sets 74S in the X-direction is equal to the middle position CP. Thus, in the X-direction, the middle position CP among all the positioning portions 74 is equal to the middle position CP among all the resilient portions 76.

Referring to FIG. 6, according to the aforementioned arrangement, each of the resilient portions 76 can more securely press the corresponding connector 20 against the corresponding positioning portion 74. However, the present invention is not limited thereto. For example, referring to FIG. 11, in the X-direction, the middle position between the resilient portion 76 and the positioning portion 74 of one of the positioning sets 74S may be different from the middle position between the resilient portion 76 and the positioning portion 74 of a remaining one of the positioning sets 74S. Moreover, each of the positioning sets 74S may include two or more of the resilient portions 76. In this case, the middle position among two or more of the resilient portions 76 in the X-direction may be equal to the middle position of the positioning portion 74 in the X-direction.

Figure 7:
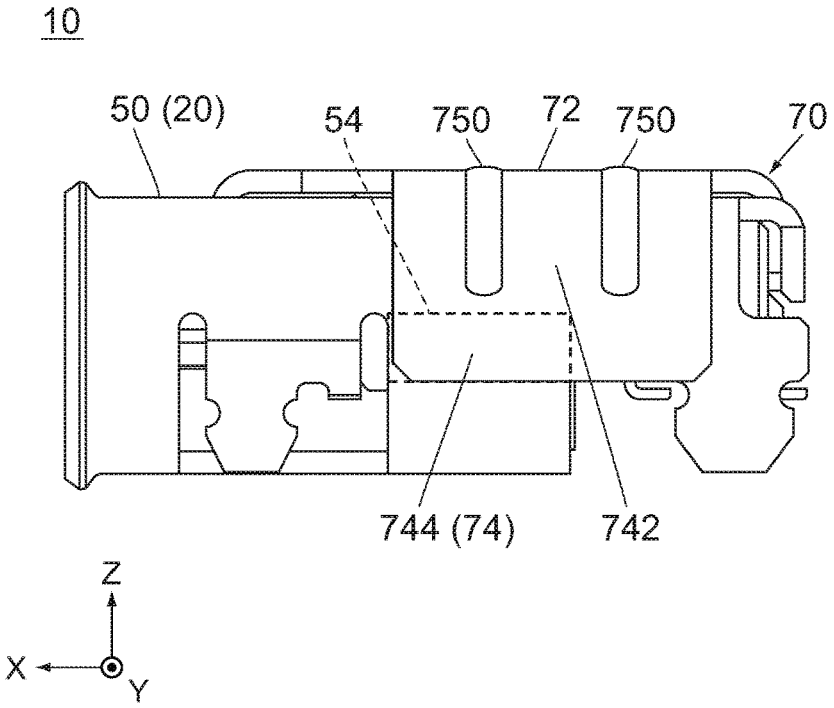
FIG. 7 is a side view showing the connector assembly of FIG. 1, wherein an outline of an outside flat portion of one of the connectors is illustrated in dotted line.

Referring to FIG. 6, in the present embodiment, each of the resilient portions 76 presses the corresponding connector 20 against the stopper 744 of the corresponding positioning portion 74. Referring to FIGS. 6 and 7, for each of the connectors 20, the outside flat portion 54 of the shell 50 is in contact with the stopper 744 of the corresponding positioning portion 74, and the inside flat portion 52 of the shell 50 is in contact with the pressing portion 764 of the corresponding resilient portion 76.

According to the present embodiment, each of the outside flat portion 54 and the inside surface of the stopper 744, which is located inside in the Y-direction, is a plane perpendicular to the Y-direction. The outside flat portion 54 is brought into surface contact with the inside surface of the stopper 744 in the Y-direction to securely press the stopper 744 outward in the Y-direction. In addition, since the inside flat portion 52 is a plane perpendicular to the Y-direction, the pressing portion 764 securely presses the inside flat portion 52 outward in the Y-direction. However, the present invention is not limited thereto. For example, as previously described, each of the inside flat portion 52, the outside flat portion 54 and the inside surface of the stopper 744, which is located inside in the Y-direction, may be an oblique plane oblique to the Y-direction. In particular, each of the stopper 744 and the outside flat portion 54 may extend along a common plane oblique to the Y-direction. Moreover, the shell 50 may have slightly curved surfaces instead of the inside flat portion 52 and the outside flat portion 54 each of which has a planar shape.

Referring to FIGS. 12 and 13, according to the present embodiment, for each of the positioning sets 74S, the stopper 744 entirely hides the pressing portion 764 so that the pressing portion 764 is invisible when the coupling member 70 is seen along the Y-direction. In other words, in each of the positioning sets 74S, an occupation area of the pressing portion 764 in the XZ-plane is included in another occupation area of the stopper 744 in the XZ-plane. According to this structure, each of the pressing portions 764 can securely press the corresponding connector 20 against the corresponding stopper 744. However, the present invention is not limited thereto. For example, for each of the positioning sets 74S, the stopper 744 may cover, at least in part, the pressing portion 764 when the coupling member 70 is seen along the Y-direction.

Referring to FIG. 1, at the time when the connectors 20 are just attached to the coupling member 70, the connector assembly 10 is in a temporarily holding state where the coupling member 70 temporarily holds each of the connectors 20 only by the resilient force. When the coupling member 70 is under the temporarily holding state, the connectors 20 and the coupling member 70 are separable from one another.

Figure 5:
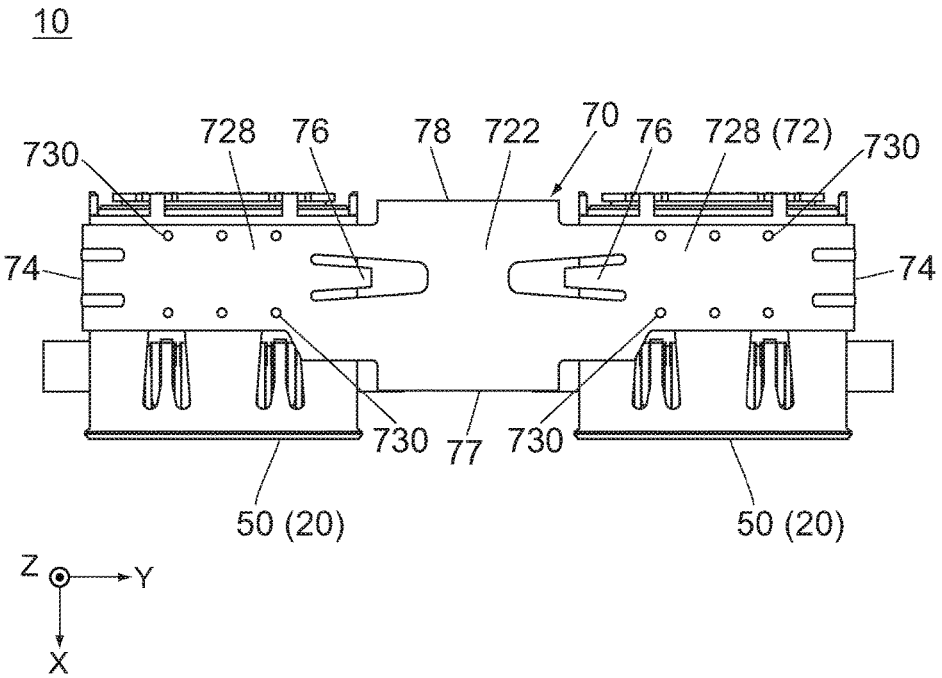
FIG. 5 is a top view showing the connector assembly of FIG. 1, wherein the two connectors are fixed to the coupling member via laser welding.

Referring to FIG. 5, each of the connectors 20 is fixed to the coupling member 70 after temporarily held by the coupling member 70, so that the coupling member 70 is in a holding state where each of the connectors 20 is unseparably fixed to the coupling member 70. According to the present embodiment, when the coupling member 70 is under the holding state, for each of the connectors 20, the shell 50 is fixed to the coupling member 70. In detail, in the present embodiment, each of the shells 50 is fixed to a plurality of welded portions 730 of the top plate 72 of the coupling member 70 via laser welding. However, the present invention is not limited thereto, but each of the connectors 20 can be fixed to the coupling member 70 by various methods. For example, in a case where the connector 20 does not comprise the shell 50, the holding member 30 of the connector 20 may be adhesively fixed to the coupling member 70.

The present embodiment can be further variously modified as described below in addition to the already described modifications.

Referring to FIG. 6, the structure of the resilient portion 76 can be variously modified. For example, each of the resilient portions 76 may be bent to extend upward after extending downward. Instead, each of the resilient portions 76 may extend forward from a rear end of the corresponding end plate 728. Moreover, the coupling member 70 may comprise a spring member, which is a member other than the coupling member 70, instead of the two resilient portions 76 each of which is a part of the coupling member 70. This spring member may be a single coil spring which has a central axis extending along the Y-direction. The coil spring may be fixed to a lower surface (negative Z-side surface) of the top plate 72. According to this structure, opposite sides of the coil spring in the Y-direction work as two resilient portions, respectively. In detail, one of the positioning sets 74S includes the positioning portion 74 and one of the opposite sides of the coil spring, and a remaining one of the positioning sets 74S includes the positioning portion 74 and a remaining one of the opposite sides of the coil spring.

Referring to FIG. 1, in a case where the shell 50 of each of the connectors 20 has no spring portion 56, each of the end plates 728 of the coupling member 70 may be formed to extend long in the X-direction and to entirely cover the upper surface of the corresponding shell 50. According to this structure, two or more of the positioning sets 74S may be provided for each of the connectors 20.

Referring to FIG. 1, when the connector assembly 10 is used, the coupling member 70 may be directly fixed to the circuit board 80 (see FIG. 8). More specifically, the coupling member 70 may have legs which are fixed to the circuit board 80. Each of the legs of the coupling member 70 may be soldered to a through-hole formed in the circuit board 80 or may be screwed to the circuit board 80.

Referring to FIG. 2, each of the end plates 728 of the coupling member 70 may be provided with a rear shield which replaces the rear side portion 58 of the shell 50 of each of the connectors 20. Each of the rear shields may extend downward from the corresponding end plate 728 to cover the corresponding connector 20 from behind. Instead, the rear reinforcement portion 78 may extend in the positive Y-direction and in the negative Y-direction to cover the rear ends of the two connectors 20.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising two connectors and a coupling member, wherein:

the coupling member couples the two connectors in a lateral direction, and the two connectors that are coupled to each other are apart from each other in the lateral direction;

the coupling member has a top plate and two positioning sets which correspond to the two connectors, respectively;

each of the positioning sets includes a positioning portion and a resilient portion;

the top plate has a single and continuous flat-plate shape and is located above the two connectors in an upper-lower direction perpendicular to the lateral direction;

each of the positioning portions extends downward from the top plate and is located outward of a corresponding one of the connectors in the lateral direction; and each of the resilient portions is fixed to the top plate, is located inward of the corresponding one of the connectors in the lateral direction and presses the corresponding one of the connectors against a corresponding one of the positioning portions.

2. The connector assembly as recited in claim 1, wherein for each of the positioning sets, the positioning portion covers, at least in part, the resilient portion when the coupling member is seen along the lateral direction.

3. The connector assembly as recited in claim 1, wherein in a front-rear direction perpendicular to both the lateral direction and the upper-lower direction, the middle position among all the positioning portions is equal to the middle position among all the resilient portions.

4. The connector assembly as recited in claim 1, wherein:

each of the positioning portions has a stopper;

each of the stoppers has a flat-plate shape intercrossing with the lateral direction; and each of the resilient portions presses the corresponding one of the connectors against the stopper of the corresponding one of the positioning portions.

5. The connector assembly as recited in claim 4, wherein:

each of the resilient portions has a support portion, which is resiliently deformable, and a pressing portion supported by the support portion; and for each of the positioning sets, the stopper covers, at least in part, the pressing portion when the coupling member is seen along the lateral direction.

6. The connector assembly as recited in claim 5, wherein each of the support portions extends downward from the top plate in the upper-lower direction.

7. The connector assembly as recited in claim 6, wherein:

the top plate has two end plates corresponding to the two connectors, respectively; and each of the end plates is arranged in the lateral direction together with a corresponding one of the positioning portions and the support portion of a corresponding one of the resilient portions.

8. The connector assembly as recited in claim 4, wherein:

each of the positioning portions has a connection portion which connects the stopper to the top plate; and each of the connection portions is formed with a rib which protrudes outward in a plane defined by the lateral direction and the upper-lower direction.

9. The connector assembly as recited in claim 1, wherein:

each of the connectors comprises a holding member, a terminal held by the holding member and a shell which covers, at least in part, the holding member; and for each of the connectors, the shell is fixed to the coupling member.

10. The connector assembly as recited in claim 4, wherein:

each of the connectors comprises a holding member, a terminal held by the holding member and a shell which covers, at least in part, the holding member;

each of the shells has an inside flat portion intersecting with the lateral direction and an outside flat portion intersecting with the lateral direction; and for each of the connectors, the shell is fixed to the coupling member, the outside flat portion is in contact with the stopper of a corresponding one of the positioning portions, and the inside flat portion is in contact with the pressing portion of a corresponding one of the resilient portions.

11. The connector assembly as recited in claim 9, wherein each of the shells is fixed to the top plate of the coupling member via laser welding.

12. The connector assembly as recited in claim 1, wherein:

the coupling member has at least one reinforcement portion;

the at least one reinforcement portion is formed on at least one of a front end and a rear end of the top plate in a front rear direction perpendicular to both the lateral direction and the upper-lower direction; and the at least one reinforcement portion extends downward from the top plate in the upper-lower direction.

13. The connector assembly as recited in claim 1, wherein the two connectors have structures same as each other.

* * * * *